US007896269B2

(12) United States Patent
Elsing

(10) Patent No.: US 7,896,269 B2
(45) Date of Patent: Mar. 1, 2011

(54) APPARATUS AND METHOD FOR COLLECTING AND CRUSHING SEASHELLS ON A BEACH

(76) Inventor: Robert J. Elsing, Green Bay, WI (US)

( * ) Notice: Subject to any disclaimer, the term of this patent is extended or adjusted under 35 U.S.C. 154(b) by 312 days.

(21) Appl. No.: 12/038,867

(22) Filed: Feb. 28, 2008

(65) Prior Publication Data

US 2009/0218423 A1 Sep. 3, 2009

(51) Int. Cl.
*B02B 1/00* (2006.01)
*B02B 5/02* (2006.01)

(52) U.S. Cl. ..... 241/56; 241/58; 241/186.2; 241/246

(58) Field of Classification Search ..... 241/246, 241/186.5, 189.1, 56, 58, 186.2
See application file for complete search history.

(56) References Cited

U.S. PATENT DOCUMENTS

| | | | | |
|---|---|---|---|---|
| 2,012,694 | A | 8/1935 | Runyan | |
| 4,667,887 | A | 5/1987 | Kawaguchi | |
| 4,739,937 | A | 4/1988 | Carpenter, Jr. et al. | |
| 4,901,401 | A | 2/1990 | Gallant | |
| 4,939,814 | A | 7/1990 | Tillion | |
| 5,085,376 | A * | 2/1992 | Litchenburg | 241/56 |
| 5,232,168 | A * | 8/1993 | Lybecker et al. | 241/24.12 |
| 5,240,188 | A * | 8/1993 | Whitmire | 241/29 |
| 5,407,079 | A * | 4/1995 | Rancourt | 209/23 |
| 5,706,879 | A | 1/1998 | Renner et al. | |
| 5,988,540 | A * | 11/1999 | Pugh | 241/46.17 |
| 6,007,010 | A | 12/1999 | Kuchersky et al. | |
| 6,401,798 | B1 | 6/2002 | Kondo | |
| 6,575,303 | B1 | 6/2003 | Brock et al. | |
| 6,691,765 | B2 | 2/2004 | Sparks et al. | |
| 7,147,034 | B2 | 12/2006 | Clayton | |
| 2005/0269436 | A1 | 12/2005 | Sawant et al. | |

FOREIGN PATENT DOCUMENTS

| | | |
|---|---|---|
| WO | 97/15398 | 5/1997 |

* cited by examiner

*Primary Examiner* — Bena Miller
(74) *Attorney, Agent, or Firm* — Andrus, Sceales, Starke & Sawall, LLP

(57) ABSTRACT

A seashell collecting and crushing apparatus includes a collection device having a hollow body and an inlet for introducing seashells into the hollow body. A fan assembly is operable to provide a suction airstream for drawing seashells into the hollow body. A crusher is positioned to receive seashells from an outlet of the collection device and pulverize the seashells received from the collection device into a fine particulate matter releasable through an outlet of the crusher. The fan assembly and the crusher are driven by a common driving arrangement. A method includes using the apparatus for removing seashells from the beach using the suction airstream to introduce seashells through the inlet into the hollow body, separating the seashells entering the hollow body from the suction airstream, pulverizing the seashells into a fine particulate matter using the crusher and exhausting the fine particulate matter through the outlet of the crusher.

18 Claims, 5 Drawing Sheets

APPARATUS AND METHOD FOR COLLECTING AND CRUSHING SEASHELLS ON A BEACH

FIELD OF THE INVENTION

The present invention relates generally to the conversion of a coarse particulate into a fine particulate. More particularly, the present invention pertains to the collecting and crushing of seashells on a beach into fine particulate matter or sand that can be returned to the beach or hauled away to be used for other purposes.

BACKGROUND OF THE INVENTION

Since 1988, when zebra mussels were officially detected in North America, their shells have been washing up in increasing numbers on the shores and beaches of the Great Lakes, most of the large navigable rivers in the eastern United States, and in many inland lakes in the Great Lakes region. Once on shore, the mussel shells have caused deterioration of the previous natural beauty and aesthetic appeal of the beaches and have created other concern because the shells are very sharp, cutting and abrasive to bare-foot humans, animals and watercraft hulls. The shells are accumulating to depths of several feet in some cases, completely changing the landscape of otherwise desirable beaches. The accumulated shells create an eye sore and stagnant water trapped in the shells can produce an offensive odor. Over the course of many years, these seashells will bleach in the sun, be crushed by wave action and turn eventually into a light-colored sand. However, because of their offensive nature, it is becoming necessary to take immediate action and haul away these seashells to remote dumping sites which causes an undesirable expense. The heavy equipment typically used can further damage the beach by creating ruts and additional environmental concerns during the removal process.

It is therefore desirable to provide an easy, environmentally friendly and economical removal and/or conversion of the seashells to a desirable fine particulate matter or sand in an expedited manner, thus restoring and, in some cases, enhancing the aesthetic value and function of the natural and original beach. It is further desirable to provide a mechanical intervention for accelerating the natural conversion of seashells accumulating on beaches.

SUMMARY OF THE INVENTION

It is a broad object of the present invention to provide an apparatus for converting coarse particulate into fine particulate matter.

It is one object of the present invention to provide an apparatus and method for on-site beach processing of seashells into a fine particulate matter or sand.

It is another object of the present invention to provide for the restoration of natural and aesthetic beauty of beaches, eliminating the undesired abrasive, and sharp cutting nature of the seashells to people, pets and watercraft, and removing the need to haul away the seashells to a remote dumping site or landfill.

It is a further object of the present invention to provide a simple, yet compact construction and use of a seashell collecting and crushing apparatus for the general public.

It is also an object of the present invention to provide an apparatus for enabling joint collecting and crushing of seashells utilizing a common driving arrangement.

The present invention relates to an apparatus for converting a coarse particulate into fine particulate matter. The apparatus includes a collection device provided with the hollow body and an inlet for introducing a coarse particulate into the hollow body. An infeed device, such as a device that creates a source of suction, is positioned relative to the collection device to transport an infeed supply of the coarse particulate into the collection device. In one embodiment, the suction device is operable to provide a suction airstream for drawing the coarse particulate into the hollow body of the collection device through the inlet. A crusher is provided with an inlet for receiving the coarse particulate from the collection device. The crusher is operable to pulverize the coarse particulate into fine particulate matter releasable through an outlet.

The apparatus includes a separator positioned in the collection device to separate the coarse particulate entering the collection device from the suction airstream such that the coarse particulate is directed towards the crusher. Preferably, the coarse particulate is separated from the airstream using cyclonic separation. A spray nozzle is optionally provided for applying moisture to the coarse particulate introduced through the inlet to prevent large clouds of dust during processing. The spray device is also operable to clean the interior of the apparatus. The suction device and the crusher are rotatably driven by a common driving arrangement. The common driving arrangement preferably includes a single drive motor.

In a specific implementation of the invention, the apparatus is a seashell collecting and crushing apparatus that includes a collection device having a hollow body and an inlet for introducing seashells into the hollow body. A fan assembly is mounted in communication with the inlet and is operable to provide a suction airstream for drawing seashells into the hollow body. A crusher is positioned to receive seashells from an outlet of the collection device. The crusher is operable to pulverize the seashells received from the collection device into fine particulate matter releasable through an outlet of the crusher. The fan assembly and the crusher are driven by a common driving arrangement.

The hollow body of the collection device includes an upper cylindrical portion, an intermediate conical portion and a lower cylindrical portion defining a feed tube into the crusher. The inlet for the collection device extends from the upper cylindrical portion of the body. The inlet for the collection device includes an elongated hose having a free end provided with a removable restrictor grid. The inlet for the collection device includes a spray nozzle adapted to be connected to a source of liquid for wetting seashells introduced through the inlet.

The common driving arrangement includes a drive shaft extending through the hollow body of a collection device and having one end drivingly connected to a single drive motor. The drive shaft rotates a feeding device, such as an auger, for directing seashells from the collection device into the crusher. A fan wheel is fixed to the drive shaft for rotation in a fan housing of the fan assembly. A pulverizing wheel is fixed to the drive shaft for rotation in a crusher housing of the crusher.

The crusher includes a crusher housing having a flat upper wall, a cylindrical side wall and a downwardly sloping bottom wall provided with the outlet. The cylindrical side wall has an inner surface provided with a series of spaced apart projections. The pulverizing wheel has an outer periphery spaced from the projections, and a plurality of spaced apart upstanding blades. The crusher includes a flapper having a counterweight for normally holding the outlet closed, thereby preventing an alternate suction path, until the weight of the fine particulate matter in the crusher overcomes the counterweight to open the outlet.

The invention further contemplates a method for processing seashells disposed on a beach. The method includes the steps of (a) providing an integrated apparatus having a collection device provided with an inlet, a driven suction device for providing a suction airstream, and a driven crusher having an outlet; (b) removing seashells from the beach using the suction device to introduce seashells through the inlet into the collection device; (c) separating the seashells entering the collection device from the suction airstream such that the seashells are directed towards the crusher; (d) pulverizing the seashells into fine particulate matter using the crusher; and (e) exhausting the fine particulate matter through the outlet.

The method includes the step of wetting the seashells introduced through the inlet, and the step of providing a common driving arrangement for the suction device and the crusher.

Various other features, objects and advantages of the invention will be made apparent from the following description taken together with the drawings.

BRIEF DESCRIPTION OF THE DRAWINGS

The drawings illustrate the best mode presently contemplated in carrying out the invention.

In the drawings.

DETAILED DESCRIPTION OF THE PREFERRED EMBODIMENT

Figure 1:
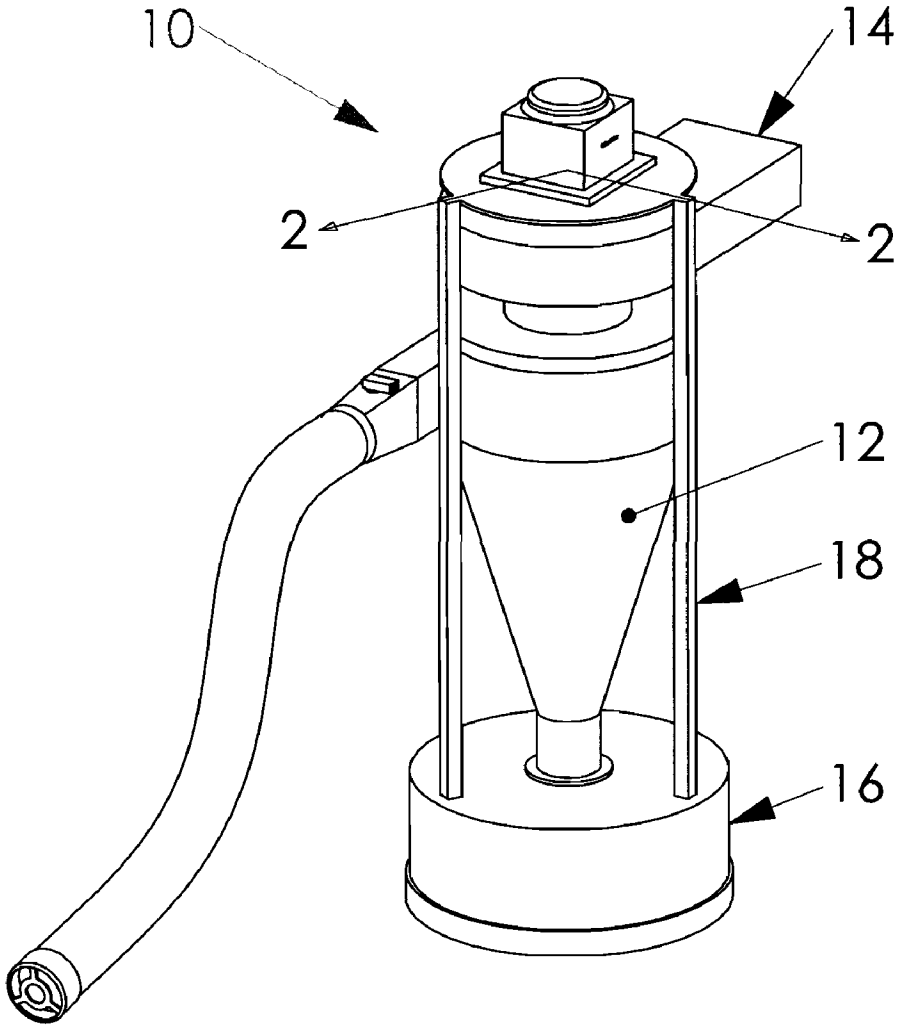
FIG. 1 is a perspective view of a seashell collecting and crushing apparatus according to the invention.

FIG. 1 generally shows an apparatus for converting a coarse particulate into a fine particulate. In the preferred application, the coarse particulate is seashells, although other particulates such as small stones or other items are contemplated. As shown in FIG. 1, the present invention is directed to a seashell collecting and crushing apparatus 10 which is particularly useful in receiving seashells accumulated on a beach, and pulverizing the seashells into a fine particulate matter. In a preferred application, the apparatus can convert zebra, quagga and other mussel seashells that wash up on a beach into a desirable sand that can be redeposited on the beach for restoration thereof, or hauled away and used for other purposes. Even if the fine particulate matter is not put to use as sand on a beach, the pulverized shells will be more efficient to transport and will take up much less space in a landfill.

As seen in FIG. 1, the seashell collecting and crushing apparatus is generally comprised of a collection device 12, a fan assembly 14, and a crusher 16 which are collectively bolstered by a framework 18.

Figure 3:
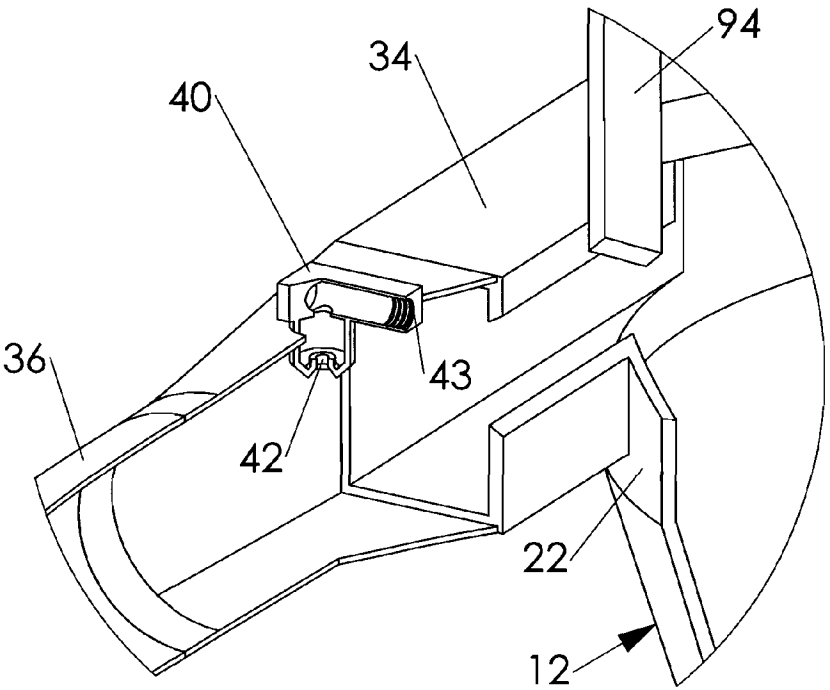
FIG. 3 is an enlarged, detail view taken on line 3-3 of FIG. 2.
Figure 2:
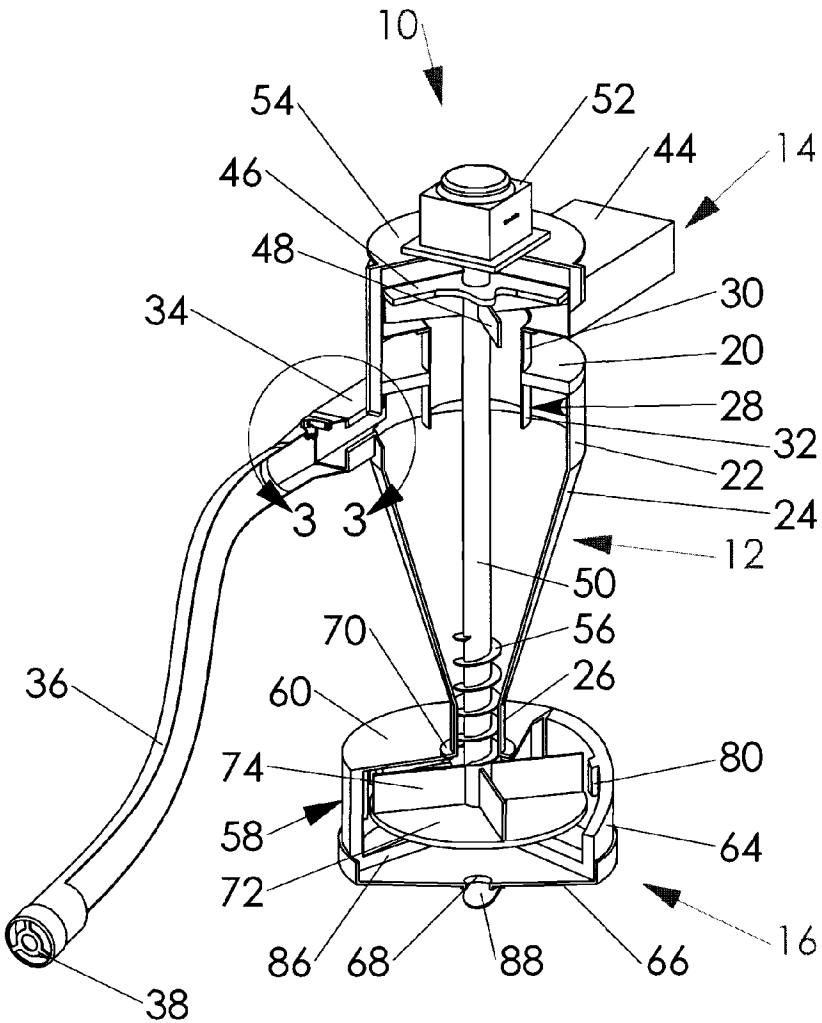
FIG. 2 is a cut away view of the seashell collecting and crushing apparatus taken on line 2-2 of FIG. 1.

Referring to FIGS. 2 and 3, the collection device 12 is a cyclonic separator, which is a hollow collector and separator structure with a circular lid 20, an upper portion 22, an intermediate conical portion 24, and a lower portion 26 defining a feed tube that opens into the crusher 16. A cylindrical inlet tube 28 extends perpendicularly through the center of lid 20, and includes an upper segment 30 that projects above lid 20 and a lower segment 32 that depends below lid 20. An inlet 34 for admitting seashells into the hollow body of the collection device 12 projects tangentially outward from the upper portion 22, and includes an elongated flexible suction hose 36. A free end of the suction hose 36 is supplied with a removable restrictor grid 38 which is sized according to the type of shells to be input to the apparatus 10. The suction hose 36 could be handheld and moved by an operator or could be attached to a machine that could be moved around the beach to collect the seashells.

As illustrated in FIG. 3, the top of inlet 34 is provided with a controllable spray nozzle 40 having a spray nozzle orifice 42 which depends into the inlet 34. The spray nozzle 40 has a threaded end 43 to which a separate hose and water supply can be connected to wet or moisten seashells introduced into the inlet 34 for a purpose to be described hereafter.

The fan assembly 14 serves as a suction device to automatically draw shells and air into the body of the collection device 12. The fan assembly 14 is mounted above the body of the collection device 12 and includes a fan housing 44 and a fan wheel 46 having a number of fan blades 48 depending therefrom. The bottom of fan housing 44 is fixed to the upper segment 30 of inlet tube 28 that forms a fan inlet. The fan wheel 46 is fixed to an upper portion of an elongated drive shaft 50 that extends through the body of the collection device 12 and passes through the inlet tube 28. A top end of the drive shaft 50 is drivingly connected to a drive motor 52 (such as driven by a gasoline engine or an electric motor) that is secured on a circular motor mounting plate 54 which is spaced slightly above the fan housing 44.

Although a suction device is shown in the illustrated embodiment as being the mechanism for drawing an infeed supply of the coarse particulate into the collection device, other types of infeed devices are contemplated as being within the scope of the invention. As an example, the infeed device used to transport the infeed supply of the coarse particulate into the collection device through the inlet could be a series of brushes and a conveyor/auger assembly that receives the coarse particulate matter, such as the seashells, and directs the supply of seashells into the collection device. In such an embodiment, the coarse particulate matter will be transported by the infeed device into the collection device where the collection device can then feed the coarse particulate matter to the crusher. Various other types of infeed devices other than a suction device are contemplated as being within the scope of the present disclosure.

The drive shaft 50 has a lower portion provided with a feeding device, such as an auger 56, used to forcefully urge seashells drawn into the body of collection device 12 to the crusher 16. Although an auger 56 formed as part of the drive-shaft 50 is shown in the Figures, other feeding devices, such as an auger separate from but attached to the drive shaft, a series of blades or pins or a series of offset steps could be coupled to the drive shaft 50 to direct the shells into the crusher 16. A bottom end of the drive shaft 50 is rotatably supported in the crusher 16.

Figure 7:
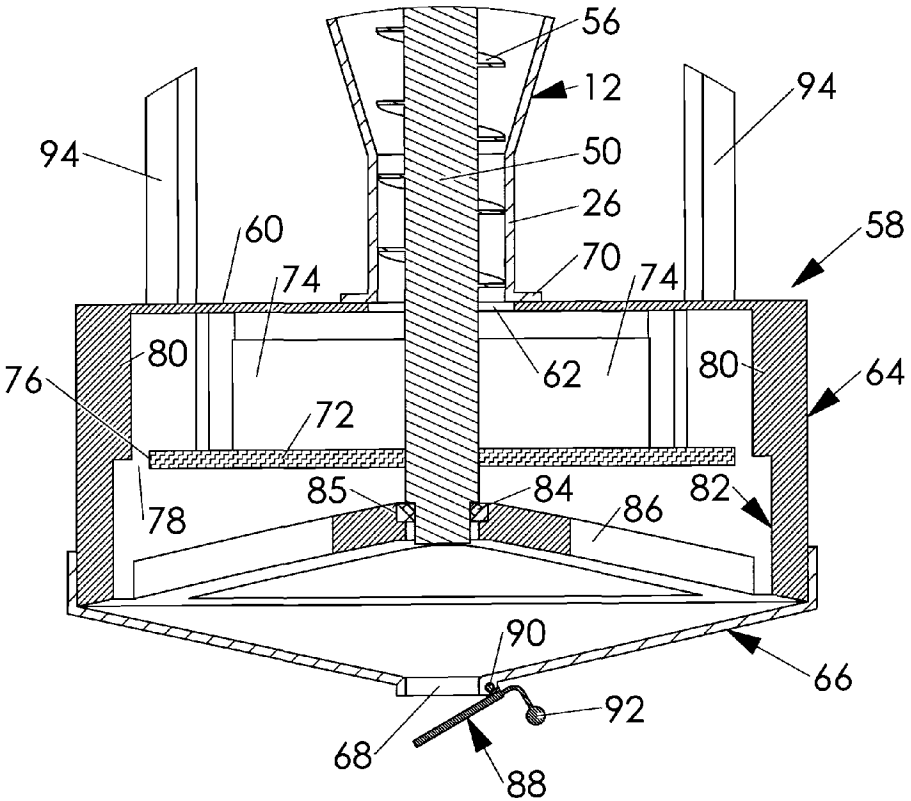
FIG. 7 is an enlarged detail view taken on line 7-7 of FIG. 6.
Figure 5:
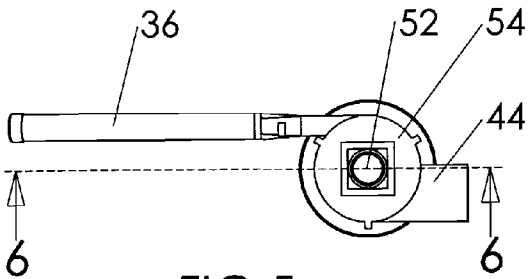
FIG. 5 is a top view of the seashell crushing and collecting apparatus.
Figure 6:
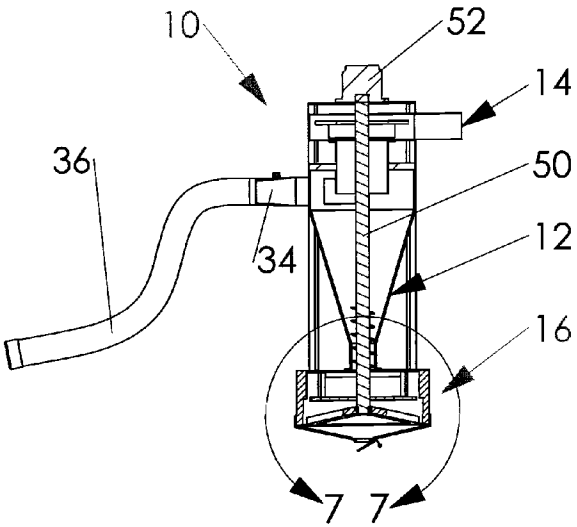
FIG. 6 is a sectional view taken on line 6-6 of FIG. 5.
Figure 8:
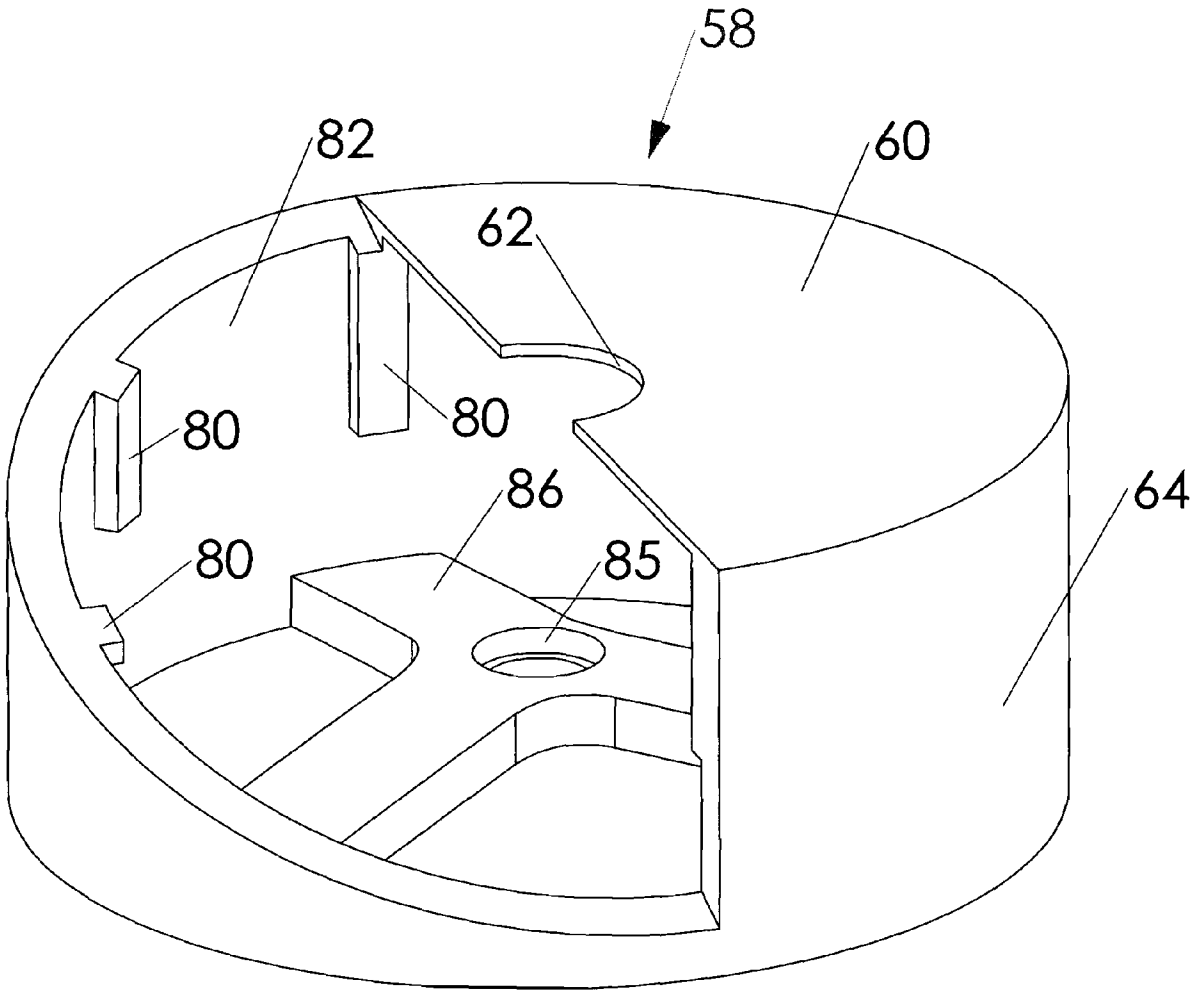
FIG. 8 is an enlarged, cut away perspective view of a crushing portion of the seashell collecting and crushing apparatus.

The crusher 16 acts to convert the coarse particulate, such as seashells, into a fine particulate matter for sand. As shown in the magnified views of FIGS. 7 and 8, the crusher 16 includes a housing 58 having a flat upper wall 60 with a central hole 62, a cylindrical side wall 64 and a downwardly sloping bottom wall 66 having a sand exhaust port or outlet 68. The feed tube 26 of collection device 12 has a flange 70 that is attached to the flat upper wall 60 so that the feed tube 26 is in communication with the interior of the housing 58. A lower end of the drive shaft 50 extends through the hole 62 into the housing 58, and is joined to a pulverizing wheel 72 having a plurality of upstanding blades 74 fixed thereto. The pulverizing wheel 72 has an outer periphery 76 that is spaced apart by a gap 78 from several projections 80 provided on an upper, inner surface 82 of the side wall 64. The bottom end of the drive shaft 50 is mounted for rotation via a bearing 84 pressed into a recess 85 of a support structure 86 that slopes upwardly from the lower end of the side wall 64. The outlet 68 is closed by a flapper 88 that is pivotally attached by a pin 90 to the bottom wall 66, and provided with a counterweight 92 such that the flapper 88 is normally held closed against the outlet 68. Alternatively, the flapper 88 could be biased to a closed position by a spring or by the physical properties of the flapper itself, such as if the flapper were formed from a flexible plastic material.

At this point, it should be appreciated that the single drive motor 52, best shown in FIG. 2, rotates the common axial drive shaft 50 which, in turn, propels the fan wheel 46, the auger 56, and the pulverizing wheel 72 so as to create a common driving arrangement.

Figure 4:
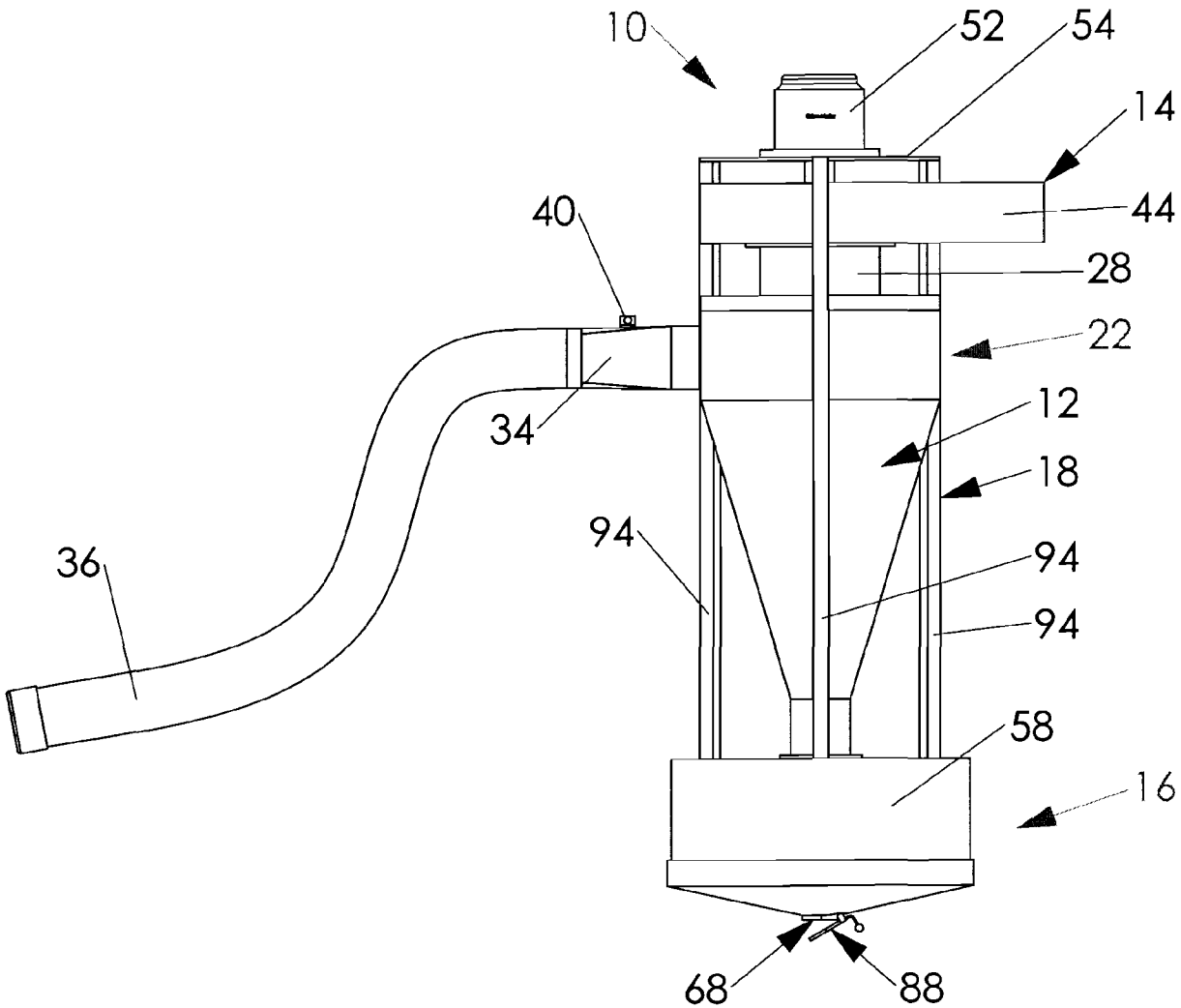
FIG. 4 is a front view of the seashell collecting and crushing apparatus shown in FIG. 1.

The framework 18 is a support structure for the apparatus 10 that includes three elongated support members 94 best shown in FIG. 4. Each support member 94 has an upper end that is connected to a periphery of the motor mounting plate 54, and a lower end that is joined to the crusher housing 58. The support members 94 are spaced equally apart and are also joined to the upper cylindrical portion 22 of the collection device 12 and the fan housing 44. Although the preferred embodiment is shown including the support members 94, it should be understood that the seashell collecting and crushing apparatus 10 could be constructed without the framework 18. In such an embodiment, individual components of the apparatus 10 could be directly connected to each other without use of the framework 18.

In use, the seashell collecting and crushing apparatus 10 is preferably operated on a beach laden with seashells. Before start up, the suction hose 36 is placed adjacent to the seashells, and the counterbalanced flapper 88 is closed to prevent entry of air from the bottom wall 66 of crusher 16. Once the drive motor 52 is energized, the fan wheel 46 is rotatably driven to create a suction airstream through inlet tube 28 which will draw seashells, air and other beach particles through the restrictor grid 38 and the suction hose 36 into the inlet 34. Here, a mist or spray of water coming from the spray nozzle orifice 42 wets the incoming seashells and other small particles to prevent large amounts of dust from being created during the operation. Alternatively, the seashells could be moistened while still on the beach prior to being drawn into the suction hose 36 to reduce the amount of dust created during the crushing process.

The seashells and any particulate from the beach are forcefully drawn tangentially in a cyclonic manner into the cylindrical portion 22 of the body 12 where the shells are separated from the suction airstream by cyclonic separation. The seashells settle out of the air stream in the lower portion of the collection device 12 where they are fed into the crusher 16 by the auger 56 which moves the seashells through the feed tube 26 at a controlled rate. At the same time, the air drawn in through the inlet 34 is pulled up through the inlet tube 28 into the fan housing 44 where air is exhausted to the atmosphere. Although cyclonic separation is described as the preferred method of separating the shells from the air stream, other methods could be used while operating within the scope of the present disclosure.

As the seashells drop from the feed tube 26 into the crusher 16, they land on pulverizing wheel 72 which is being rotatably driven by the drive shaft 50. The pulverizing wheel 72 has numerous blades 74 that accelerate the seashells radially outwardly away from the drive shaft 50. The accelerated seashells are flung off the pulverizing wheel 72 at a high velocity and smash into the inner surface 82 of the cylindrical side wall 64 and the projections 80 thereon. Here, the seashells are pulverized and reduced to a fine particulate matter or sand by the violence of the impact.

Although cyclonic crushing is shown in the Figures and described above, other types of crushers are contemplated as being within the scope of the present disclosure. As an example, the crusher 16 could be a hammer mill, jaw crusher or other similar type of crushing device.

Once the seashells are pulverized, the newly created fine particulate matter or sand drops down through the gap 78 between the periphery 76 of the pulverizing wheel 72 and the inner surface 82 of the cylindrical side wall 64 to outer ends of downwardly sloped crusher bottom 66. The speed of the pulverizing wheel 72 and the size of the gap 78 combine to determine the size of the fine particulate matter. The fine particulate matter or sand slides down the sloped crusher bottom 66 towards the exhaust port or outlet 68 where the weight of the sand eventually forces open the counterbalanced flapper 88 and the sand falls from the apparatus 10. Upon being exhausted, the newly created sand can be returned directly to the beach, or can be collected in a receptacle for later redistribution or secondary processing such as further refinement. As the sand is exhausted, a portion of the air is admitted through the outlet 68 and moves upwardly through the crusher 16, the feed tube 26, the body of the collection device 12, the inlet tube 34 and the fan housing 44 to be exhausted into the atmosphere.

The present invention thus provides an integrated apparatus and method for effectively converting and processing the accumulation of mussel and other seashells on existing beaches into a desirable fine particulate matter or sand, which can be returned to the beach or collected for subsequent distribution. The present invention further provides a suction airstream for removing seashells from the beach, collecting and separating the seashells and other related beach particles from the airstream by means of a cyclonic hopper-separator, enabling exhaust air to return to atmosphere, feeding the seashells and particulates to a cyclonic crusher at a controlled rate of feed, accelerating the seashells and related beach particles to a sufficiently high velocity, smashing the seashells and beach particles to a desired fine particulate matter or sand, and then exhausting the refined sand particles back to the beach. The present invention enables the above operating steps to take place by employing a common driving arrangement which enables a minimum number of parts and compact assembly for maximizing economic benefits. The shell collecting and crushing apparatus also eliminates the expense required to haul away uncrushed shells to a remote dumping site which saves space in landfills.

It should be understood that separating the seashells from the airstream is the preferred method of the invention. The reason for this is small rocks and other debris from the beach could be ingested by the apparatus 10 along with the shells and damage the fan wheel 46 and blades 48 or reduce efficiency. That said, the fan wheel 46 and blades 48 could be placed in line between the suction hose 36 and crusher 16 and accomplish much the same job, however, the fan would wear out at a faster pace and require more maintenance and cost. The apparatus 10 may be sized as desired depending on application. For example, a small apparatus may be mounted on a backpack, a larger apparatus mounted on wheels, and an even larger apparatus mounted on a vehicle such as truck, boat or barge. If mounted to a boat or barge, the sand and/or exhaust from the fan assembly 14 could be exhausted under water to minimize noise and dust. The suction hose 36 can have an appropriate length such that the apparatus 10 may remain on board a transport vehicle that is near, but not directly on the beach. Different and multiple driving arrangements other than motor 52 may be used and positioned other than on top of the apparatus 10. The dust controlling spray nozzle 40 may take other forms of wetting devices, and may be used to wet the seashells either before, during or after the crushing operation. Further, the spray nozzle may be used to clean the inside of the apparatus. In an economy version, the suction fan assembly 14 may be eliminated and the seashells could be loaded manually into the body.

In yet another contemplated embodiment, the suction device could be designed to both create the suction airstream to draw the seashells from the beach and reduce the size of the seashells collected. In such an embodiment, the suction device could be designed with a crushing device, such as a contact plate or surface positioned such that the infeed supply of seashells drawn into the suction device would be directed at a high velocity against the contact plate or surface. The contact between the seashells and the contact plate would fracture the seashells and thus decrease the size of the shell particles. If the collision between the seashells and the contact plate is sufficiently violent, the size of the resulting particles may be small enough to return to the beach without further crushing.

Various alternatives and embodiments are contemplated as being within the scope of the following claims particularly pointing out and distinctly claiming the subject matter regarded as the invention.

I claim:

1. An apparatus for converting a coarse particulate into fine particulate matter comprising:

a collection device provided with an inlet for receiving an infeed supply of the coarse particulate;

a suction device operable to provide a suction airstream to transport the infeed supply of the coarse particulate into the collection device through the inlet, wherein the collection device is configured to separate the coarse particulate from the suction airstream; and a crusher provided with an inlet connected to the collection device for receiving the coarse particulate separated from the suction airstream in the collection device, the crusher being operable to pulverize the coarse particulate into fine particulate matter releasable through an outlet, wherein the suction device and the crusher are driven by a common driving arrangement.

2. The apparatus of claim 1, wherein the common driving arrangement includes a single drive motor.

3. The apparatus of claim 1, further comprising a spray nozzle for applying moisture to the coarse particulate introduced through the inlet.

4. The apparatus of claim 3, wherein the spray nozzle is selectively operable to direct a spray of water to clean the collection device and the crusher.

5. A seashell collecting and crushing apparatus comprising:

a collection device having a hollow body and an inlet for introducing seashells into the hollow body;

a suction device mounted in communication with the inlet for the collection device and operable to provide a suction airstream for drawing seashells into the hollow body through the inlet, wherein the collection device is configured to separate the seashells from the suction airstream; and a crusher positioned to receive seashells from an outlet of the collection device, the crusher being operable to pulverize the seashells received from the collection device into fine particulate matter releasable through an outlet of the crusher, whereby the suction device and the crusher are rotatably driven by a common driving arrangement.

6. The apparatus of claim 5, wherein the collection device is configured to separate the seashells from the suction airstream using cyclonic separation.

7. The apparatus of claim 5, wherein the inlet for the collection device includes an elongated hose having a free end provided with a removable restrictor grid.

8. The apparatus of claim 5, wherein the inlet for the collection device includes a spray nozzle adapted to be connected to a source of liquid for wetting seashells introduced through the inlet.

9. The apparatus of claim 8, wherein the spray nozzle is selectively operable to direct the source of liquid to clean the collection device and the crusher following use of the seashell collecting and crushing apparatus.

10. A seashell collecting and crushing apparatus comprising:

a collection device having a hollow body and an inlet for introducing seashells into the hollow body, wherein the hollow body of the collection device includes an upper portion, an intermediate conical portion and a lower portion defining a feed tube into the crusher, wherein the inlet for the collection device extends from the upper portion of the body;

a suction device mounted in communication with the inlet for the collection device and operable to provide a suction airstream for drawing seashells into the hollow body through the inlet, wherein the collection device is configured to separate the seashells from the suction airstream; and a crusher positioned to receive seashells from the feed tube of the hollow body of the collection device, the crusher being operable to pulverize the seashells received from the collection device into fine particulate matter releasable through an outlet of the crusher, whereby the suction device and the crusher are rotatably driven by a common driving arrangement.

11. A seashell collecting and crushing apparatus comprising:

a collection device having a hollow body and an inlet for introducing seashells into the hollow body;

a suction device mounted in communication with the inlet for the collection device and operable to provide a suction airstream for drawing seashells into the hollow body through the inlet; and a crusher positioned to receive seashells from an outlet of the collection device, the crusher being operable to pulverize the seashells received from the collection device into fine particulate matter releasable through an outlet of the crusher, whereby the suction device and the crusher are rotatably driven by a common driving arrangement including a drive shaft extending through the hollow body of the collection device and having one end drivingly connected to a single drive motor, the drive shaft operating a feeding device for directing seashells from the collection device into the crusher.

12. The apparatus of claim 11, wherein the feeding device is an auger operatively coupled to the drive shaft.

13. The apparatus of claim 11, wherein a fan wheel is fixed to the drive shaft for rotation in a fan housing of the suction device.

14. The apparatus of claim 13, wherein a pulverizing wheel is fixed to the drive shaft for rotation in a crusher housing of the crusher.

15. A seashell collecting and crushing apparatus comprising:

a collection device having a hollow body and an inlet for introducing seashells into the hollow body;

a suction device mounted in communication with the inlet for the collection device and operable to provide a suction airstream for drawing seashells into the hollow body through the inlet; and a crusher positioned to receive seashells from an outlet of the collection device, the crusher being operable to pulverize the seashells received from the collection device into fine particulate matter releasable through an outlet of the crusher, wherein the crusher includes a crusher housing having a cylindrical side wall and a downwardly sloping bottom wall provided with the outlet, whereby the suction device and the crusher are rotatably driven by a common driving arrangement.

16. The apparatus of claim 15, wherein the cylindrical side wall has an inner surface provided with a series of spaced apart projections.

17. The apparatus of claim 16, wherein the crusher includes a pulverizing wheel rotatable within the crusher housing, the pulverizing wheel having an outer periphery spaced from the projections.

18. The apparatus of claim 17, wherein the pulverizing wheel has a plurality of spaced apart upstanding blades.

* * * * *